US005407066A

United States Patent [19]

Grange

[11] Patent Number: 5,407,066

[45] Date of Patent: Apr. 18, 1995

[54] PACKING UNIT

[75] Inventor: Kenneth Grange, London

[73] Assignee: Warner-Lambert Company, Morris Plains, N.J.

[21] Appl. No.: 183,564

[22] Filed: Jan. 18, 1994

Related U.S. Application Data

[63] Continuation of Ser. No. 999,728, Dec. 31, 1992, which is a continuation of Ser. No. 782,150, Oct. 25, 1991.

[30] Foreign Application Priority Data

Oct. 27, 1990 [DE] Germany ..... 9014877 U

[51] Int. Cl.[6] ..... B65D 73/00; B65D 85/00

[52] U.S. Cl. ..... 206/228; 206/352; 206/467; 206/471

[58] Field of Search ..... 206/461, 462, 463, 464, 206/465, 467, 468, 469, 470, 471, 493, 495, 352, 353, 354, 355, 356, 357, 358, 359, 360, 228

[56] References Cited

U.S. PATENT DOCUMENTS

| | | | |
|---|---|---|---|
| 1,643,171 | 9/1927 | Orme | 206/228 X |
| 2,822,916 | 2/1958 | Wash et al. | 206/228 |
| 2,925,905 | 2/1960 | Metzler et al. | 206/228 |
| 3,045,812 | 7/1962 | Randolph | 206/228 |
| 3,084,791 | 4/1963 | Hawley . | |
| 3,178,019 | 4/1965 | Fetzek | 206/464 X |
| 3,366,268 | 1/1968 | Struck | 206/228 X |
| 3,444,990 | 5/1969 | Braginetz | 206/228 X |
| 3,861,528 | 1/1975 | Damuth | 206/463 |
| 3,933,245 | 1/1976 | Mullen | 206/461 X |
| 4,091,927 | 5/1978 | Lunsford | 206/461 X |
| 4,453,629 | 6/1984 | Goldberg | 206/461 X |
| 4,496,047 | 1/1985 | Gatley | 206/354 |
| 4,512,474 | 4/1985 | Harding | 206/467 X |
| 4,619,364 | 10/1986 | Czopor, Jr. | 206/470 X |
| 4,669,610 | 6/1987 | Lindsey et al. | 206/471 X |
| 4,804,984 | 2/1989 | Heuer et al. | 206/461 X |
| 4,848,541 | 7/1989 | Paliotta et al. | 206/461 X |
| 4,872,551 | 10/1989 | Theros | 206/471 X |
| 4,896,770 | 1/1990 | Calcerano et al. | 206/461 X |
| 4,899,877 | 2/1990 | Kiernan | 206/471 X |
| 5,029,705 | 7/1991 | Schmidt et al. | 206/471 X |

FOREIGN PATENT DOCUMENTS

| | | |
|---|---|---|
| 2615830 | 12/1988 | France . |
| 8903715 | 3/1989 | Germany . |

*Primary Examiner*—Jacob K. Ackun
*Attorney, Agent, or Firm*—Robert W. Becker & Associates

[57] ABSTRACT

A packing unit for objects which comprises two portions that are connected to one another and form a space therebetween for receiving an object is provided. Both portions are made from a plastic foil and have profilings according to the shape of the object that form abutments to prevent sliding of the object within the packing unit.

8 Claims, 3 Drawing Sheets

PACKING UNIT

This application is a continuation of application Ser. No. 07/999,728, filed Dec. 31, 1992, which is a continuation of application Ser. No. 782,150, filed Oct. 25, 1991.

BACKGROUND OF THE INVENTION

The present invention relates to packing unit for objects which comprises two portions that are connected to one another whereby between the two portions a space is formed for receiving the object and whereby one of the two portions is made from a plastic foil and has profilings according to the shape of the object.

Such packing units for objects used for their storage and presentation, for example, at respective sale racks in the form of so-called blisters are well known. They consist essentially of two parts between which the object is disposed. One of the parts is usually cardboard which is provided with the respective product information and forms the back wall of the packing unit. Onto this flat cardboard part a transparent plastic foil is attached, for example, glued. The plastic foil is formed or shaped corresponding to the shape of the object to be contained therein.

A disadvantage of the aforementioned packing units is that objects of a complicated shape cannot be held in place, for example, shavers for wet-shaving together with the corresponding holders and the corresponding dispensers for razor-blade units are difficult to position properly in such blisters. Objects contained in the aforementioned packing units will usually not remain in their position and will move and be displaced within the packing unit. In the case of assembled objects this may result in dismounting of the object into its individual parts so that the desired presentation of the object is destroyed. Furthermore, the objects within such packing units rattle when exposed to the slightest movement.

It is therefore an object of the present invention to provide an improved packing unit which holds in place objects of a complicated shape.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The packing unit of the present invention is primarily characterized by two portions that are connected to one another whereby the two portions form a space therebetween for receiving an object and whereby the portions are made from a plastic foil and have profilings according to the shape of the object.

A packing unit according to the present invention has the advantage that objects contained therein may be held in position securely without the object or objects within the packing unit sliding out of place due to movements to which the packing unit subjected. This is especially advantageous for objects of a complicated shape such as shavers for wet-shaving with respective holders and dispensers for razor-blade units. Due to respective profilings of the two plastic foil portions the objects are held securely in place and prevent sliding within the packing unit. The profilings of the plastic foil portions must not be such that the profilings correspond exactly to the shape of the object. It is sufficient that individual areas of the plastic foil portions are respectively profiled to hold the object in place so that a sliding of the object within the packing unit is prevented. It is thus only important that the profilings provide effective abutments within the plastic foil portions for the object to be held in the packing unit.

In a preferred embodiment the profilings are formed by projections and recesses. These projections and recesses are inwardly and outwardly oriented projections within the otherwise planar plastic foil material. The shape of the respective projections or recesses may be selected as desired and depends on the shape of the object to be positioned in the packing unit.

In another embodiment of the packing unit the portion forming the back wall of the packing unit is curved. Preferably, the portion forming the back wall is outwardly curved.

In a further embodiment of the packing unit it is suggested that between the two portions made from plastic foil an insert preferably made of cardboard is positioned. This insert is employed to provide product information thereon. The two plastic foil portions are preferably made from transparent plastic material. This is especially expedient for the portion which forms the front cover. The plastic foil portion which forms the back wall of the packing unit may however consist of colored plastic material.

DESCRIPTION OF PREFERRED EMBODIMENTS

The present invention will now be described in detail with the aid of several specific embodiments utilizing FIGS. 1 through 3.

Figure 1:
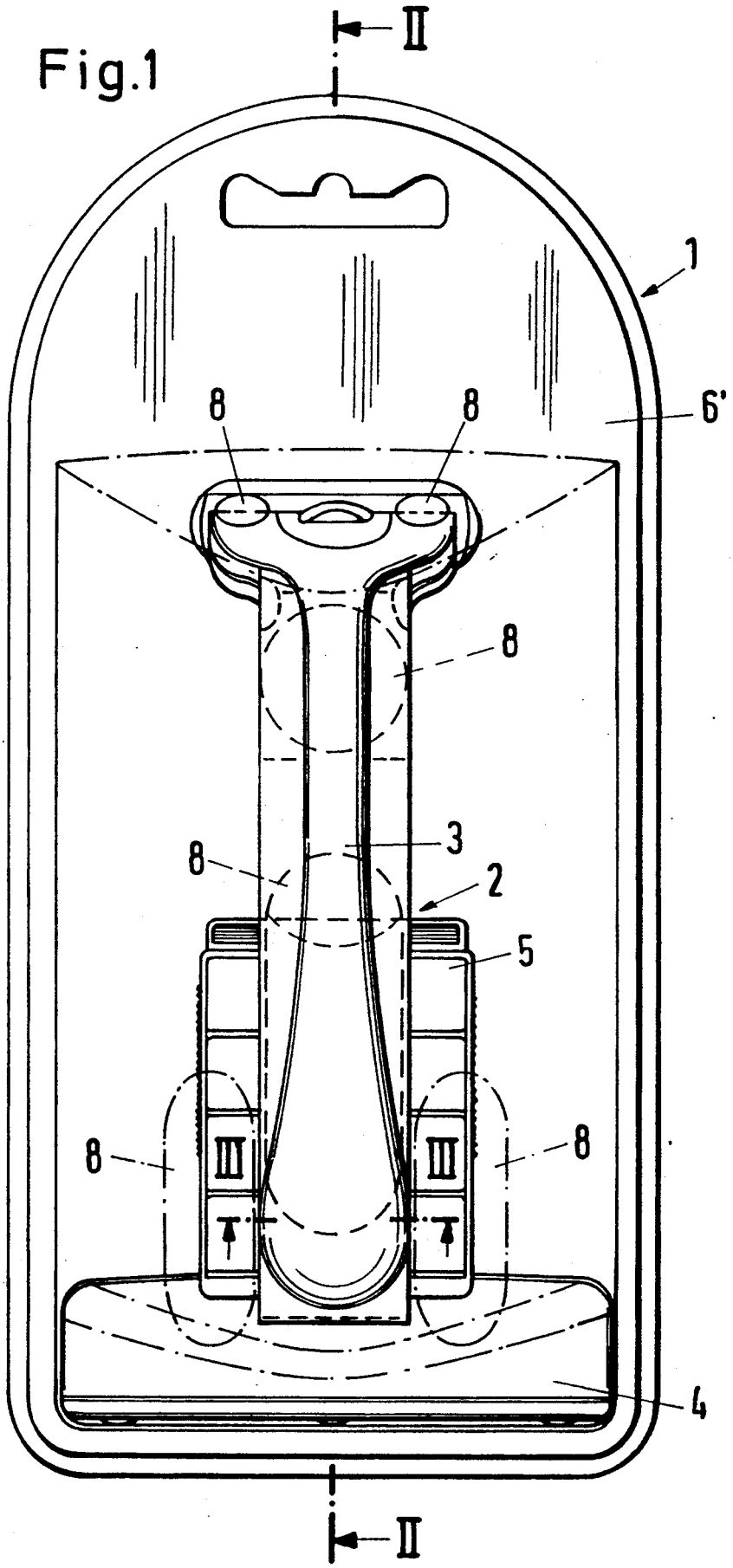
FIG. 1 is an end view of the packing unit with an object in the form of a shaver for wet-shaving with the corresponding holder and dispenser for razor-blade units positioned therein.
Figure 2:
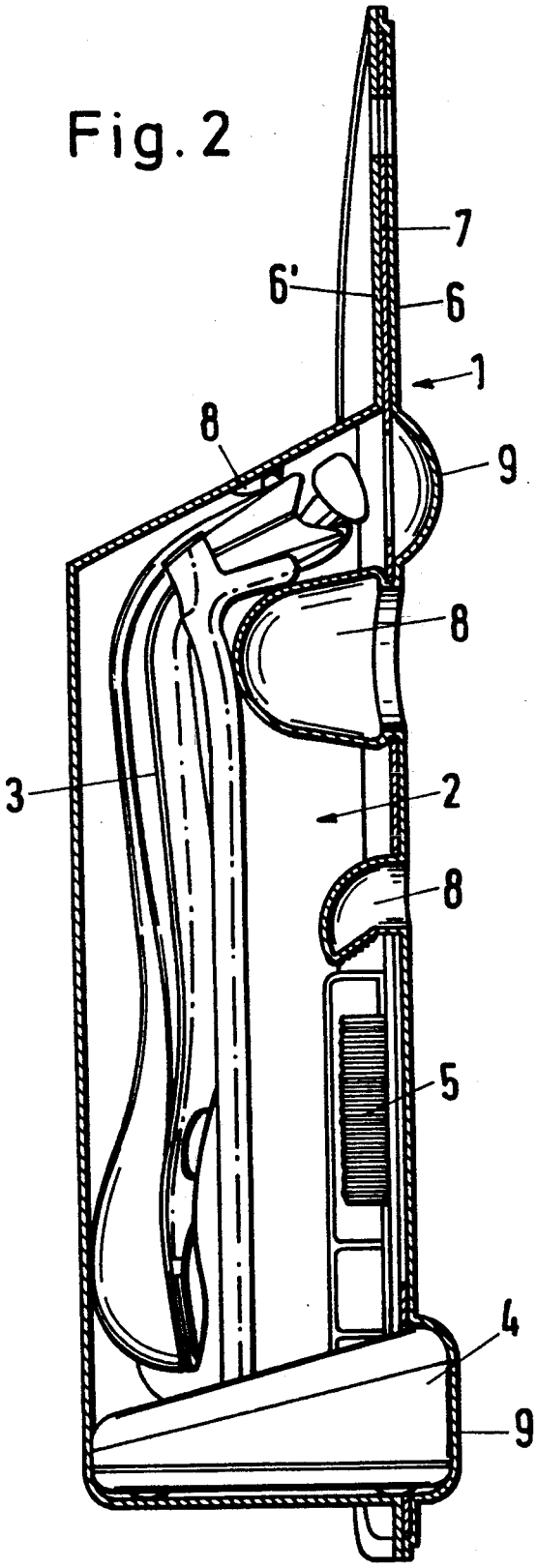
FIG. 2 shows a view along the line II—II of FIG. 1.
Figure 3:
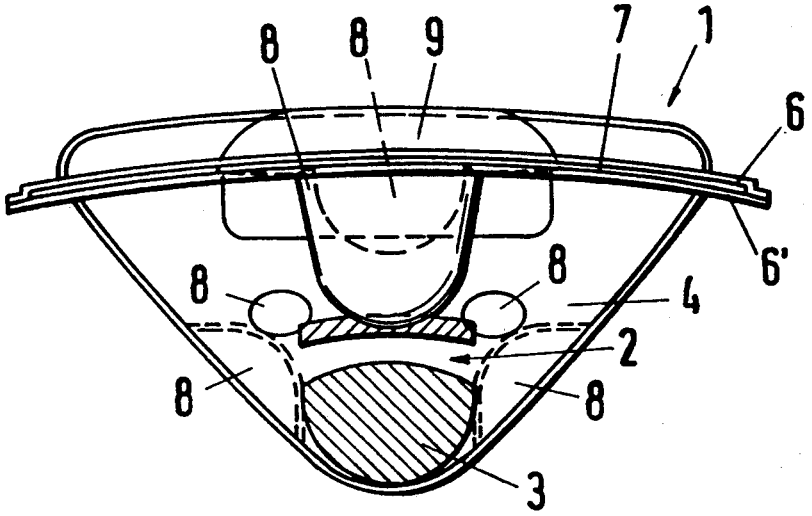
FIG. 3 is a plan view of the packing unit according to FIGS. 1 and 2 whereby in order to facilitate the understanding of the drawing the handle of the shaver and the base portion of the holder are cross-sectioned along the line III—III of FIG. 1.

FIGS. 1 through 3 show a packing unit 1 for holding and presenting an object 2. The represented object is a shaver for wet shaving 3 with a corresponding holder 4 in which the shaver 3 is suspended and a dispenser 5 for razor-blade units for the shaver 3. The box-shaped dispenser 5 is inserted into a slot-like recess at the base portion of the holder 4.

The packing unit 1 comprises two plastic foil portions 6, 6' which are transparent. The two portions abut one another at a dividing plane and are fastened to one another at their edges, for example, they are glued together. As can be seen from the cross-sectional representation according to FIG. 2 the plastic foil portion 6 forms an essentially planar back wall of the packing unit 1 while the other plastic foil portion 6' bulges outwardly and provides a space for receiving the object 2. The back wall which is formed by the plastic foil portion 6 is not completely planar but is slightly curved as can be seen from the representation according to FIG. 3.

Between the two plastic foil portions 6, 6' a cardboard insert 7 is positioned which is flush with the back wall formed by the plastic foil portion 6 and which contains the product information thereon.

As mentioned before, between the two plastic foil portions 6, 6' of the packing unit 1 the object 2 is held in place. In order to prevent the object 2 from sliding within the packing unit 1 the object is held such that respective abutments are provided at all sides of the object. For this purpose, the two plastic foil portions 6, 6' are provided with respective profilings in the form of projections 8 and recesses 9. In a respective recess 9 of the back wall formed by the plastic foil portion 6 the holder 4, for example, is positioned in a nonslidable manner, while nose-like projections 8 provide abutments for the shaver 3 and the dispenser 5. The arrangement of the projections 8 is such that the individual parts of the object are positioned in a rattle-free and nonslidable manner.

Respective profiled plastic foil portions 6, 6' may simply be produced by deep-drawing, whereby it is only required to provide the plastic foil portions 6, 6' with respective abutments at certain positions which prevent an accidental sliding of the object within the packing unit.

The present invention is, of course, in no way restricted to the specific disclosure of the specification and drawings, but also encompasses any modifications within the scope of the appended claims.

What I claim is:

1. A combination of a packing unit and a shaver handle, a shaver head, and a dispenser for razor blades, said packing unit comprising:

two portions that are connected to one another at a dividing plane of said packing unit, said two portions forming a space therebetween for receiving said shaver handle, said shaver head, and said dispenser;

said portions being made from a plastic foil and having profilings according to a shape of said shaver handle, said shaver head, and said dispenser, with said profilings being formed by deforming said plastic foil inwardly so as to form projections extending inwardly into said space and by deforming said plastic foil outwardly so as to form recesses extending outwardly from said space, with said recesses and projections remaining in contact with said shaver handle, said shaver and said dispenser, thus effectively preventing movement of said shaver handle, said shaver head, and said dispenser with respect to said packing unit.

2. A packing unit according to claim 1, wherein one of said portions forms a back wall of said packing unit and is convexly curved.

3. A packing unit according to claim 1, wherein between said two portions an insert is positioned.

4. A packing unit according to claim 3, wherein said insert is made from cardboard.

5. A packing unit in combination with a shaver, a dispenser for razor blade units, and a holder, said packing unit comprising:

two portions that are connected to one another at a dividing plane of said packing unit, said two portions forming a compartment with substantially planar walls;

each said portion being made from a plastic foil;

said shaver, said dispenser and said holder received in said compartment;

said two portions having first projections in said planar walls made by deforming said plastic foil inwardly so as to extend into said compartment and second projections in said planar walls made by deforming said plastic foil outwardly so as to extend outwardly from said compartment; and said first and second projections serving as abutments for said shaver, said dispenser, and said holder for holding said shaver, said dispenser and said holder in a rattle-free and non-slidable manner.

6. A packing unit according to claim 5, wherein one of said portions forms a back wall of said packing unit and is convexly curved.

7. A packing unit according to claim 5, wherein between said two portions an insert is positioned.

8. A packing unit according to claim 7, wherein said insert is made from cardboard.

* * * * *